US008262348B2

(12) United States Patent
Diakunchak

(10) Patent No.: US 8,262,348 B2
(45) Date of Patent: Sep. 11, 2012

(54) TURBINE BLADE TIP GAP REDUCTION SYSTEM

(75) Inventor: Ihor S. Diakunchak, Ontario (CA)

(73) Assignee: Siemens Energy, Inc., Orlando, FL (US)

( * ) Notice: Subject to any disclaimer, the term of this patent is extended or adjusted under 35 U.S.C. 154(b) by 1191 days.

(21) Appl. No.: 12/099,406

(22) Filed: Apr. 8, 2008

(65) Prior Publication Data

US 2009/0252602 A1 Oct. 8, 2009

(51) Int. Cl.
*F01D 11/08* (2006.01)

(52) U.S. Cl. ..... 415/173.3; 415/174.3

(58) Field of Classification Search ..... 277/349, 277/411, 413, 433, 424, 545; 415/170.1, 415/173.1, 173.2, 173.3, 173.4, 173.5, 173.6, 415/174.2, 174.3, 174.5; 416/228
See application file for complete search history.

(56) References Cited

U.S. PATENT DOCUMENTS 2,314,289 A * 3/1943 Salisbury ..... 415/173.6
2,459,850 A * 1/1949 Stine ..... 415/173.4
3,117,716 A 1/1964 Wernicke
5,234,318 A 8/1993 Brandon
5,622,474 A 4/1997 Werner et al.
5,628,622 A 5/1997 Thore et al.
5,735,667 A 4/1998 Sanders et al.
5,752,802 A 5/1998 Jones
6,142,739 A 11/2000 Harvey
6,206,642 B1 * 3/2001 Matheny et al. ..... 416/230
6,435,513 B2 8/2002 Skinner et al.
6,488,471 B1 12/2002 Stibich et al.
6,508,624 B2 1/2003 Nadeau et al.
6,514,045 B1 2/2003 Barton et al.
6,926,495 B2 * 8/2005 Diakunchak ..... 415/173.3
6,966,755 B2 11/2005 Garner
7,118,329 B2 10/2006 Goodman
7,549,841 B1 * 6/2009 Marussich ..... 415/173.3

* cited by examiner

*Primary Examiner* — Edward Look
*Assistant Examiner* — Ryan Ellis

(57) ABSTRACT

A turbine blade sealing system for reducing a gap between a tip of a turbine blade and a stationary shroud of a turbine engine. The sealing system includes a plurality of flexible seal strips extending from a pressure side of a turbine blade generally orthogonal to the turbine blade. During operation of the turbine engine, the flexible seal strips flex radially outward extending towards the stationary shroud of the turbine engine, thereby reducing the leakage of air past the turbine blades and increasing the efficiency of the turbine engine.

20 Claims, 3 Drawing Sheets

TURBINE BLADE TIP GAP REDUCTION SYSTEM

STATEMENT REGARDING FEDERALLY SPONSORED RESEARCH

Development of this invention was supported in part by the United States Department of Energy, Contract No. DE-FC26-05NT42644. Accordingly, the United States Government may have certain rights in this invention.

FIELD OF THE INVENTION

This invention is directed generally to turbine engines, and more particularly to systems for sealing gaps between turbine blade tips and stationary shrouds in turbine engines so as to improve turbine engine efficiency by reducing leakage.

BACKGROUND

Typically, gas turbine engines are formed from a combustor positioned upstream from a turbine blade assembly. The turbine blade assembly is formed from a plurality of turbine blade stages coupled to discs that are capable of rotating about a longitudinal axis. Each turbine blade stage is formed from a plurality of blades extending radially about the circumference of the disc. Each stage is spaced apart from each other a sufficient distance to allow turbine vanes to be positioned between each stage. The turbine vanes are typically coupled to the shroud and remain stationary during operation of the turbine engine.

The tips of the turbine blades are located in close proximity to an inner surface of the shroud of the turbine engine. There typically exists a gap between the blade tips and the shroud of the turbine engine so that the blades may rotate without striking the shroud. During operation, high temperature and high pressure gases pass the turbine blades and cause the blades and disc to rotate. These gases also heat the shroud and blades and discs to which they are attached causing each to expand due to thermal expansion. After the turbine engine has been operating at full load conditions for a period of time, the components reach a maximum operating condition at which maximum thermal expansion occurs. In this state, it is desirable that the gap between the blade tips and the shroud of the turbine engine be as small as possible to limit leakage past the blade tips.

However, reducing the gap cannot be accomplished by simply positioning the components so that the gap is minimal under full load conditions because the configuration of the components forming the gap must account for emergency shutdown conditions in which the shroud, having less mass than the turbine blade and disc assembly, cools faster than the turbine blade assembly. In emergency shutdown conditions, the diameter of the shroud reduces at a faster rate than the length of the turbine blades. Therefore, unless the components have been positioned so that a sufficient gap has been established between the turbine blades and the turbine shroud under operating conditions, the turbine blades may strike the stationary shroud because the diameter of components of the shroud is reduced at a faster rate than the turbine blades. Collision of the turbine blades and the shroud often causes severe blade tip rubs and may result in damage. Thus, a need exists for a system for reducing gaps between turbine blade tips and a surrounding shroud under full load operating conditions while accounting for necessary clearance under emergency shutdown conditions.

SUMMARY OF THE INVENTION

This invention is directed to a turbine blade seal system usable in a turbine engine. In particular, the sealing system is operable to reduce a gap between one or more tip walls of a turbine blade in a turbine engine and a surrounding stationary shroud while the turbine engine is operating. The sealing system reduces the size of the gap during turbine engine operation. The gap exists in the turbine engine so that the tip walls do not contact the stationary shroud while the turbine engine is operating. Reducing the size of the gap during turbine engine operation reduces the amount of the hot gas that can pass by the turbine blade tip without imparting a load onto the blade, thereby increasing the efficiency of the turbine engine.

The turbine blade may be formed from a generally elongated blade having a leading edge, a trailing edge, a tip wall at a first end, and a root coupled to the blade at an end generally opposite the first end for supporting the blade and for coupling the blade to a disc. The turbine blade seal system may include a plurality of flexible seal strips extending generally orthogonally from a region proximate to an intersection between the generally elongated blade and the tip wall. The plurality of flexible seal strips extend radially no further than the tip wall of the generally elongated blade when the generally elongated blade is at rest. The plurality of flexible seal strips may be attached to a pressure side of the generally elongated blade. A portion of each seal strip may be attached to the pressure side of the generally elongated blade, and each blade may be bent to extend generally orthogonally away from the pressure side of the blade. The plurality of flexible seal strips may have substantially similar lengths. The plurality of flexible seal strips at least partially overlap each other to form a continuous barrier. The flexible seal strips are sufficiently flexible such that during operation in which the generally elongated blade is rotated in a blade assembly, the seal strips flex radially outward to reduce the gap between the tip wall of the generally elongated blade and the stationary shroud.

The plurality of flexible seal strips may be formed from metal. For instance, the plurality of flexible seal strips may be formed from a high strength, high temperature superalloy, such as, but not limited to, PM 2000. To retain the mechanical properties of the superalloy, the plurality of flexible strips are bonded, using transient liquid phase bonding, or brazed onto the generally elongated blade.

An advantage of this invention is that the seal strips are attached to the pressure side of the turbine blade and extend generally away from the airfoil and do not extend radially beyond the tip wall, thereby not becoming problematic during installation and other activities.

Another advantage of this invention is that the seal strips flex radially outwardly towards the outer, stationary shroud in such a position that should the seal strips contact the shroud, the seal strips will flex inwardly without damage.

Yet another advantage of this invention is that the seal strips flex radially outwardly towards the outer, stationary shroud in such a position that a film of gases is formed between the seal strips and the stationary shroud that prevents the seal strips from contacting the stationary shroud, thereby preventing damage to the seal strips.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
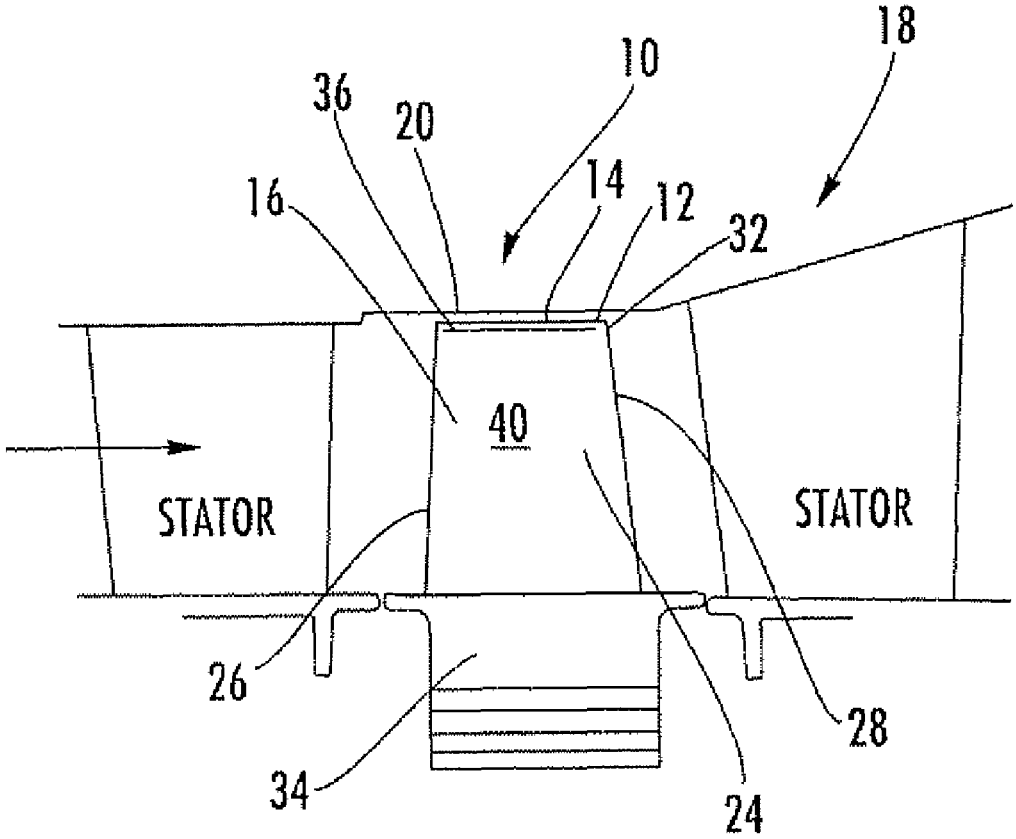
FIG. 1 is a cross-sectional side view of a turbine engine.

As shown in FIGS. 1-4, this invention is directed to a turbine blade seal system 10 usable in a turbine engine. In particular, the sealing system 10 is operable to reduce a gap 12 between one or more tip walls 14 of a turbine blade 16 in a turbine engine 18 and a surrounding stationary shroud 20 while the turbine engine 18 is operating. The sealing system 10 reduces the gap 12 to the gap 22 during turbine engine operation. The gap 22 exists in the turbine engine 18 so that the tip walls 14 do not contact the stationary shroud 20 while the turbine engine 18 is operating. Reducing the gap 12 to the gap 22 during turbine engine operation reduces the amount of the hot gas that can pass by the turbine blade tip wall 14 without imparting a load onto the blade, thereby increasing the efficiency of the turbine engine 18.

Figure 2:
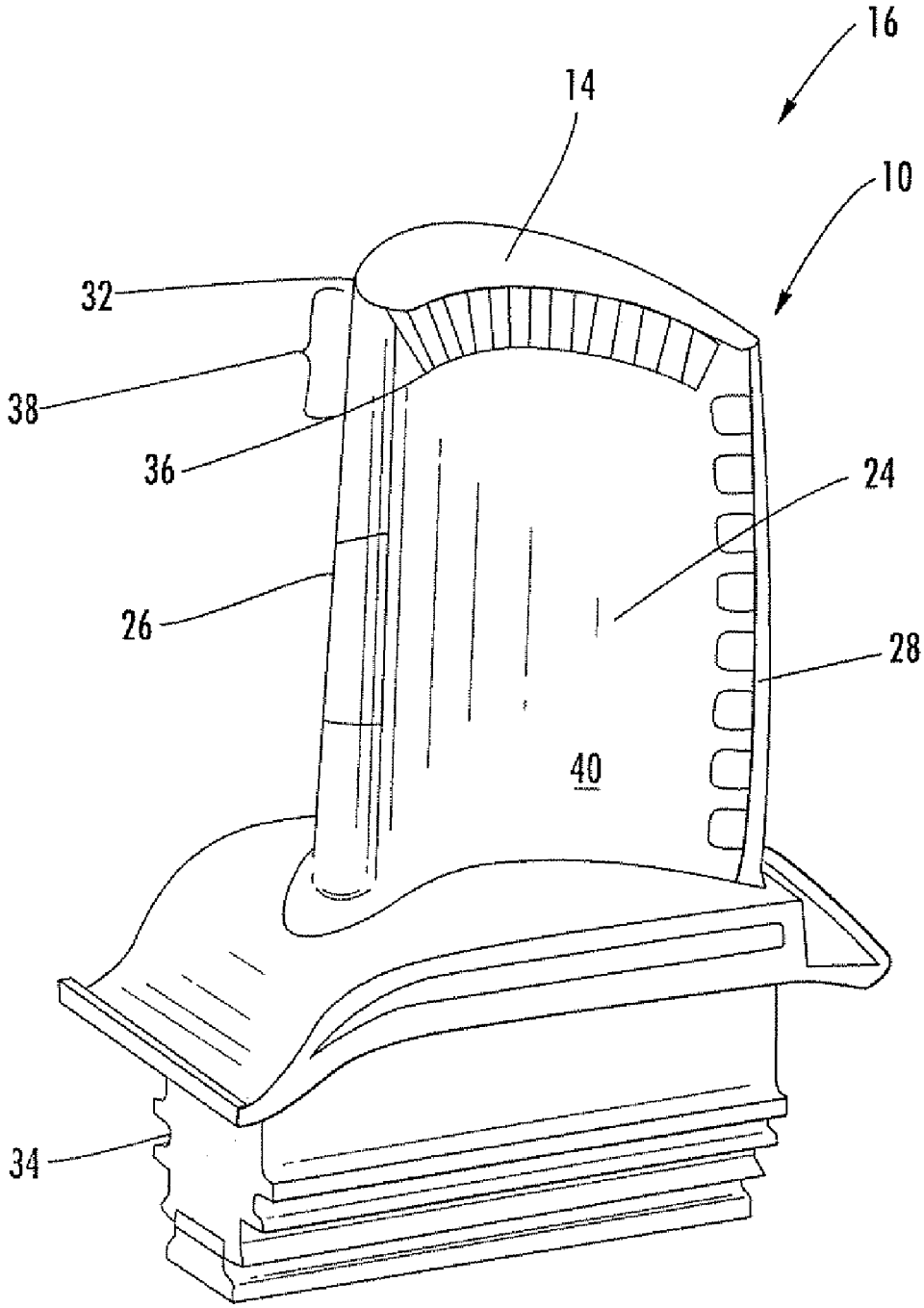
FIG. 2 is a perspective view of a turbine blade of this invention.

As shown in FIG. 2, the turbine blade 16 may be formed from a generally elongated blade 24 having a leading edge 26, a trailing edge 28 opposite to the leading edge 26, a tip wall 14 at a first end 32, and a root 34 coupled to the blade 16 at an end generally opposite the first end 32 for supporting the blade 16 and for coupling the blade 16 to a disc. The turbine blade 16 may have any appropriate configuration and is not limited to the configuration shown in the figures.

Figure 4:
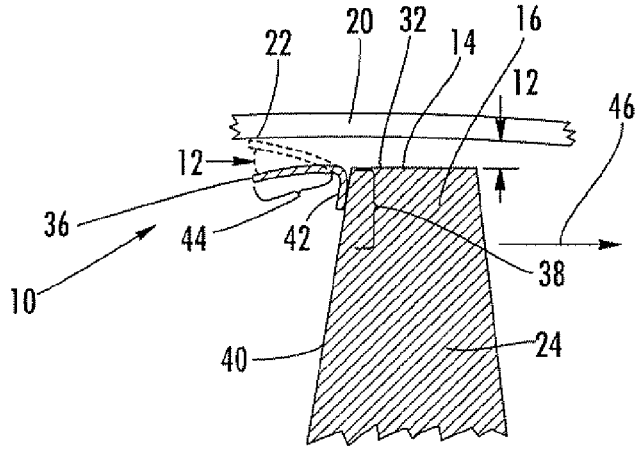
FIG. 4 is a partial cross-sectional side view of a turbine blade of this invention taken along section line 4-4 in FIG. 3.

The turbine blade seal system 10 may be formed from a plurality of flexible seal strips 36 extending generally orthogonally from a region 38 proximate to an intersection between the generally elongated blade 24 and the tip wall 14. The plurality of flexible seal strips 36 may extend generally orthogonal to a longitudinal axis of the generally elongated blade 24. The plurality of seal strips 36 may be attached to a pressure side 40 of the generally elongated blade 24 such that the seal strips 36 extend away from the direction of rotation 46 of the turbine blade 16, as shown in FIG. 4. In such an embodiment, a portion of each turbine blade 16 may be attached to the pressure side 40 of the generally elongated blade 24. The seal strips 36 may extend a distance from the turbine blade 16 at least as great as the length of the gap 22 and less than a distance between the turbine blade 16 and an adjacent turbine blade. The seal strips 35 may extend a length between about 2 millimeters and 12 millimeters (between 0.08 inches to 0.5 inches). The flexible seal strips 36 may have a width between about 1 millimeter and about 4 millimeters (between about 0.04 inches and 0.25 inches).

The seal strips 36 may at least partially overlap each other to form a continuous barrier to prevent gases from flowing therethrough and may have substantially similar lengths. The flexible seal strips 36 may be sufficiently flexible such that during operation in which the generally elongated blade 24 is rotated in a blade assembly, the seal strips 36 flex radially outward to reduce the gap 12 between the tip wall 14 of the generally elongated blade 24 and the stationary shroud 20 to gap 22. Gap 22 is the size of the gap during turbine engine operation. The seal strips 36 may be formed from metal, such as a high strength, high temperature superalloy, such as, but not limited to, PM 2000 and IN738. The plurality of seal strips 36 may be bonded or brazed to the elongated blade 24.

Each seal strip 36 may include a base 42 and a sealing section 44. The base 42 may be formed by bending the seal strip 36. In one embodiment, the base 42 may be attached to the elongated blade 24 such that the sealing section 44 is flush with the tip wall 14 and extends orthogonally from the blade 16 such that the seal strip 36 does not extend radially beyond the turbine blade 16 when the turbine blade 16 is at rest. The sealing section 44 may be generally linear. In another embodiment, the base 42 may be attached to the generally elongated blade 24 radially inboard of the intersection of the generally elongated blade 24 and the tip wall 14.

Figure 3:
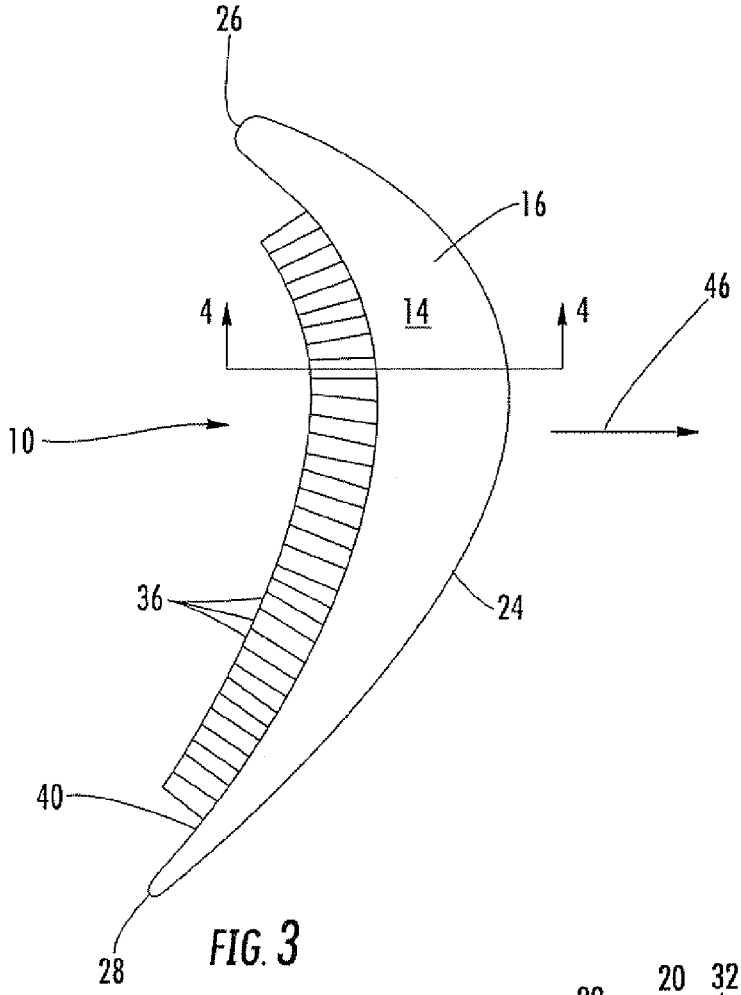
FIG. 3 is top view of the turbine blade of this invention.

The seal strips 36 may be attached to the pressure side 40 from the leading edge 26 to the trailing edge 28. In one embodiment, as shown in FIG. 3, the seal strips 36 may extend from proximate to the leading edge 26 to proximate the trailing edge 28. In particular, the seal strips 36 may be offset inwardly from the leading and trailing edges 26, 28 along the pressure side 40 toward a centerline of the generally elongated blade 24. Also, as shown in FIG. 3, the pressure side 40 may be concave. The seal strips 36 may extend orthogonally from the pressure side 40 and thus, the seal strips 36 may not be exactly aligned with each other but rather follow the contour of the pressure side 40.

During use, combustion gases contact the turbine blade 16 and cause the turbine blade 16 to rotate in the direction of the arrow 46 shown in FIG. 4. The seal strips 36 may extend from the stationary seal strip position with gap 12 in which the seal strip does not extend radially beyond the tip wall 14 to a running seal strip position with a reduced gap 22. Centrifugal forces may bend the thin and flexible seal strips 36 towards the stationary outer shroud 20 because the centrifugal force is greater than forces created by the outer annulus boundary air in the gap 12 that tries to force the seal strip 36 radially inward. The net result is the reduced gap 22. The boundary layer swept by the rotating turbine blade 16 creates a thin film of gases, which tends to keep the bent seal strips 36 from rubbing against the stationary shroud 20. If the seal strips 36 do contact the stationary shroud 20, the thin flexible seal strips 36 will be forced downward without causing damage. Hard facing on the outer surfaces of the seal strips 36 prevents seal abrasion. One material that may be used to form the hard facing is STELLITE, manufactured by Deloro Stellite Company, Houston, Tex. Reducing the gap 12 substantially reduces the combustion gas blow by, thereby increasing the efficiency of the turbine engine 18.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade sealing system for reducing a gap between a tip of a turbine blade and a stationary shroud of a turbine engine, comprising:

a generally elongated blade having a leading edge, a trailing edge, a tip wall at a first end, and a root coupled to the blade at an end generally opposite the first end for supporting the blade and for coupling the blade to a disc;

a plurality of flexible seal strips extending generally orthogonally from a region proximate to an intersection between the generally elongated blade and the tip wall;

wherein the plurality of flexible seal strips at least partially overlap each other to form a continuous barrier; and wherein the flexible seal strips are sufficiently flexible such that during operation in which the generally elongated blade is rotated in a blade assembly, the seal strips flex radially outward to reduce the gap between the tip wall of the generally elongated blade and the stationary shroud;

wherein the plurality of flexible seal strips are attached to a pressure side of the generally elongated blade.

2. The turbine blade sealing system of claim 1, wherein a portion of each seal strip is attached to the pressure side of the generally elongated blade and each strip is bent to extend generally orthogonally away from the pressure side of the blade.

3. The turbine blade sealing system of claim 1, wherein the plurality of flexible seal strips are formed from metal.

4. The turbine blade sealing system of claim 3, wherein the plurality of flexible seal strips are formed from a high strength, high temperature superalloy.

5. The turbine blade sealing system of claim 4, wherein the plurality of seal strips are formed from PM 2000.

6. The turbine blade sealing system of claim 4, wherein the plurality of flexible strips are bonded onto the generally elongated blade.

7. The turbine blade sealing system of claim 4, wherein the plurality of flexible strips are brazed onto the generally elongated blade.

8. The turbine blade sealing system of claim 4, wherein the plurality of flexible seal strips do not extend radially beyond the tip wall of the generally elongated blade when the generally elongated blade is at rest.

9. A turbine blade sealing system for reducing a gap between a tip of a turbine blade and a stationary shroud of a turbine engine, comprising:

a generally elongated blade having a leading edge, a trailing edge, a tip wall at a first end, and a root coupled to the blade at an end generally opposite the first end for supporting the blade and for coupling the blade to a disc;

a plurality of flexible seal strips having substantially similar length and attached to a region proximate to an intersection between a pressure side of the generally elongated blade and the tip wall;

wherein the plurality of flexible seal strips at least partially overlap each other to form a continuous barrier and wherein a portion of each seal strip is attached to the pressure side of the generally elongated blade and each seal strip is bent to extend generally orthogonally away from the pressure side of the blade; and wherein the flexible seal strips are sufficiently flexible such that during operation in which the generally elongated blade is rotated in a blade assembly, the seal strips flex radially outward to reduce the gap between the tip wall of the generally elongated blade and the stationary shroud.

10. The turbine blade sealing system of claim 9, wherein the plurality of flexible seal strips extend from proximate the leading edge to proximate the trailing edge.

11. The turbine blade sealing system of claim 9, wherein the plurality of flexible seal strips are formed from metal.

12. The turbine blade sealing system of claim 11, wherein the plurality of flexible seal strips are formed from a high strength, high temperature superalloy.

13. The turbine blade sealing system of claim 12, wherein the plurality of seal strips are formed from PM 2000.

14. The turbine blade sealing system of claim 12, wherein the plurality of flexible strips are bonded onto the generally elongated blade.

15. The turbine blade sealing system of claim 12, wherein the plurality of flexible strips are brazed onto the generally elongated blade.

16. The turbine blade sealing system of claim 12, wherein the plurality of flexible seal strips extend radially no further than the tip wall of the generally elongated blade when the generally elongated blade is at rest.

17. A turbine blade sealing system for reducing a gap between a tip of a turbine blade and a stationary shroud of a turbine engine, comprising:

a generally elongated blade having a leading edge, a trailing edge, a tip wall at a first end, and a root coupled to the blade at an end generally opposite the first end for supporting the blade and for coupling the blade to a disc;

a plurality of flexible seal strips having substantially similar length and attached to a region proximate to an intersection between a pressure side of the generally elongated blade and the tip wall;

wherein the plurality of flexible seal strips at least partially overlap each other to form a continuous barrier, wherein a portion of each seal strip is attached to the pressure side of the generally elongated blade and each seal strip is bent to extend generally orthogonally away from the pressure side of the blade and wherein the plurality of flexible seal strips extend from proximate the leading edge to proximate the trailing edge;

wherein the flexible seal strips are sufficiently flexible such that during operation in which the generally elongated blade is rotated in a blade assembly, the seal strips flex radially outward to reduce the gap between the tip wall of the generally elongated blade and the stationary shroud; and wherein the plurality of flexible seal strips extend radially no further than the tip wall of the generally elongated blade when the generally elongated blade is at rest.

18. The turbine blade sealing system of claim 17, wherein the plurality of flexible seal strips are formed from a high strength, high temperature superalloy.

19. The turbine blade sealing system of claim 18, wherein the plurality of seal strips are formed from PM 2000.

20. A turbine blade sealing system for reducing a gap between a tip of a turbine blade and a stationary shroud of a turbine engine, comprising:

a generally elongated blade having a leading edge, a trailing edge, a tip wall at a first end, and a root coupled to the blade at an end generally opposite the first end for supporting the blade and for coupling the blade to a disc;

a plurality of flexible seal strips extending generally orthogonally from a region proximate to an intersection between the generally elongated blade and the tip wall;

wherein the plurality of flexible seal strips at least partially overlap each other to form a continuous barrier;

wherein the flexible seal strips are sufficiently flexible such that during operation in which the generally elongated blade is rotated in a blade assembly, the seal strips flex radially outward to reduce the gap between the tip wall of the generally elongated blade and the stationary shroud;

wherein the plurality of flexible seal strips are formed from metal;

wherein the plurality of flexible seal strips are formed from a high strength, high temperature superalloy; and wherein the plurality of flexible seal strips do not extend radially beyond the tip wall of the generally elongated blade when the generally elongated blade is at rest.

* * * * *